US007814608B1

(12) United States Patent
Catello

(10) Patent No.: US 7,814,608 B1
(45) Date of Patent: Oct. 19, 2010

(54) SCRAPING SYSTEM

(76) Inventor: Charles Catello, 1675 Yucatan Ct., Henderson, NV (US) 89012

( * ) Notice: Subject to any disclaimer, the term of this patent is extended or adjusted under 35 U.S.C. 154(b) by 974 days.

(21) Appl. No.: 11/612,140

(22) Filed: Dec. 18, 2006

(51) Int. Cl.
*A47L 13/022* (2006.01)

(52) U.S. Cl. ..... 15/236.01; 30/169

(58) Field of Classification Search ..... 15/236.01, 15/236.08; 30/169
See application file for complete search history.

(56) References Cited

U.S. PATENT DOCUMENTS

| | | | | |
|---|---|---|---|---|
| 3,906,577 | A | 9/1975 | Brucher | |
| D243,060 | S | 1/1977 | Graham et al. | |
| 4,821,418 | A | 4/1989 | Windhanger | |
| 5,056,226 | A | 10/1991 | Gringer | |
| 5,208,984 | A * | 5/1993 | Negus | 30/169 |
| 5,924,204 | A | 7/1999 | Lane | |
| 5,996,231 | A | 12/1999 | Roche et al. | |
| 6,519,801 | B1 * | 2/2003 | Chao | 15/236.01 |
| 2001/0037577 | A1 | 11/2001 | Stefanopulos et al. | |
| 2004/0143924 | A1 * | 7/2004 | Salmon | 15/236.1 |

* cited by examiner

*Primary Examiner*—Randall Chin

(57) ABSTRACT

A scraping system for facilitating changing of a blade and cleaning after scraping a surface includes a base member. An upper extension is attached to the base member and extends upwardly at an angle with respect to the base member. A lower extension is attached to the base member and extends downwardly at an angle with respect to the base member. A lower arm is coupled to the lower extension. An upper arm is pivotally coupled to the upper extension of the base member. The upper arm is pivotal towards the lower arm to abut the lower arm. A blade is positioned on the lower arm. The upper arm is biased against the lower arm and the blade to press the blade between the upper and lower arms and inhibit sliding of the blade when the blade is scraped across a surface.

10 Claims, 4 Drawing Sheets

SCRAPING SYSTEM

BACKGROUND OF THE INVENTION

1. Field of the Invention

The present invention relates to scraping tools and more particularly pertains to a new scraping tool for the facilitating of changing of a blade and for the cleaning of the scraper after the blade has been used to scrape a surface.

2. Description of the Prior Art

The use of scraping tools is known in the prior art. While these devices fulfill their respective, particular objectives and requirements, the need remains for a system that has certain improved features to allow a pair of arms of the system to be pivoted apart to allow removal and replacement of the blade of the system. Additionally, the system may be readily cleaned after scraping of surface when the arms are pivoted apart.

SUMMARY OF THE INVENTION

The present invention meets the needs presented above by generally comprising a base member. An upper extension is attached to the base member and extends upwardly at an angle with respect to the base member. A lower extension is attached to the base member and extends downwardly at an angle with respect to the base member. A lower arm is coupled to the lower extension. An upper arm is pivotally coupled to the upper extension of the base member. The upper arm is pivotal towards the lower arm to abut the lower arm. A blade is positioned on the lower arm. The upper arm is biased against the lower arm and the blade to press the blade between the upper and lower arms and inhibit sliding of the blade when the blade is scraped across a surface.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

The objects of the invention, along with the various features of novelty which characterize the invention, are pointed out with particularity in the claims annexed to and forming a part of this disclosure.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
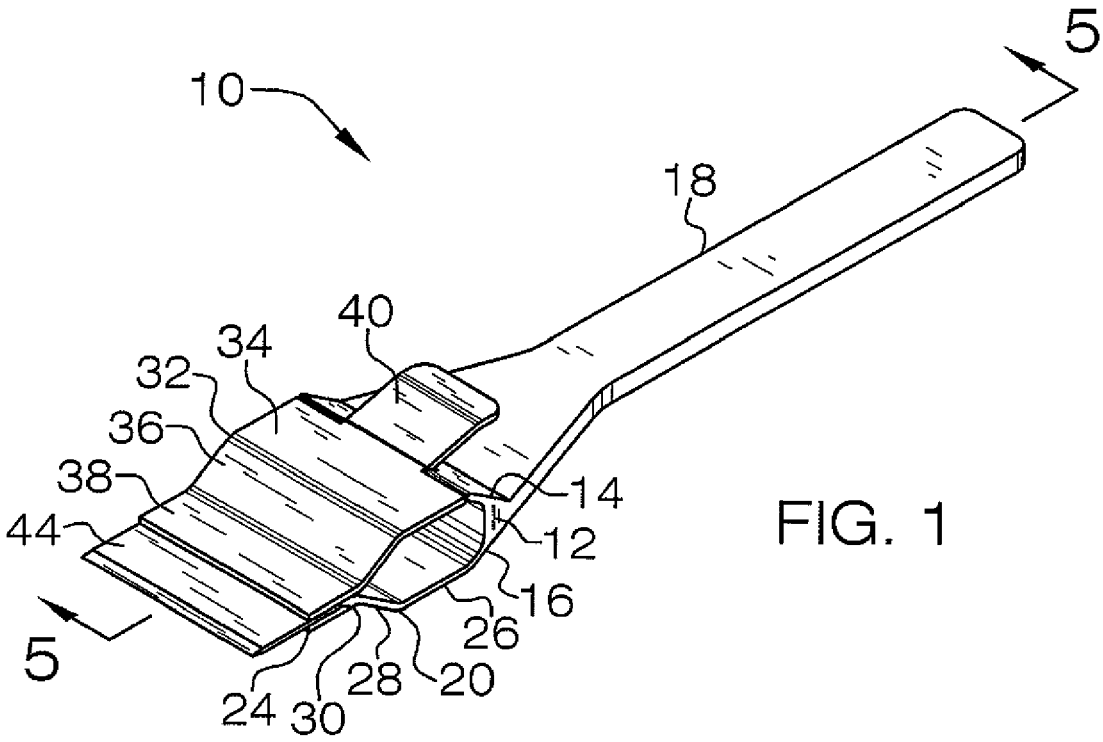
FIG. 1 is a front perspective view of a scraping system according to the present invention.
Figure 2:
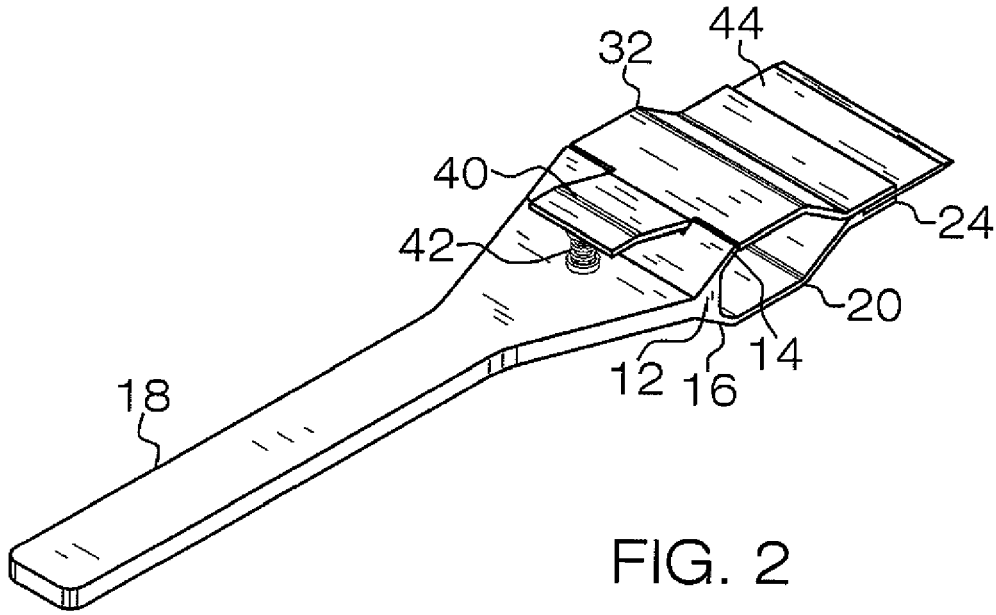
FIG. 2 is a rear perspective view of the present invention.
Figure 3:
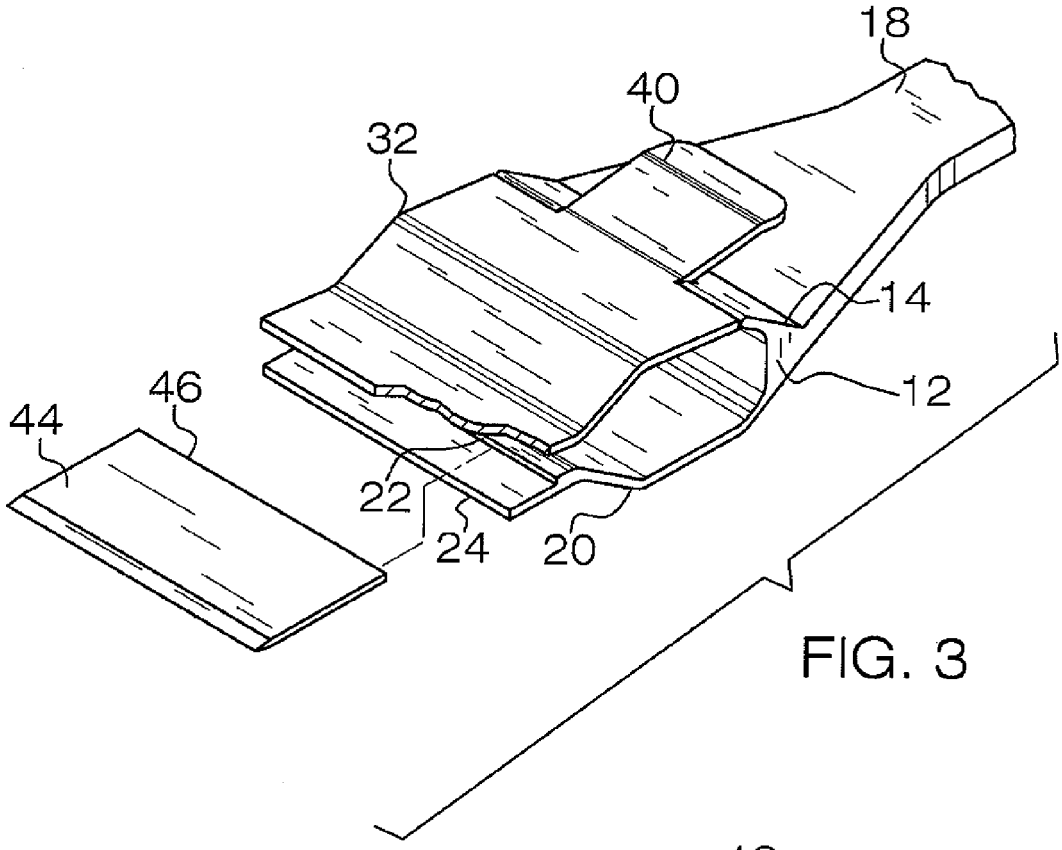
FIG. 3 is an enlarged perspective view of the present invention showing the blade removed from the lower arm.
Figure 4:
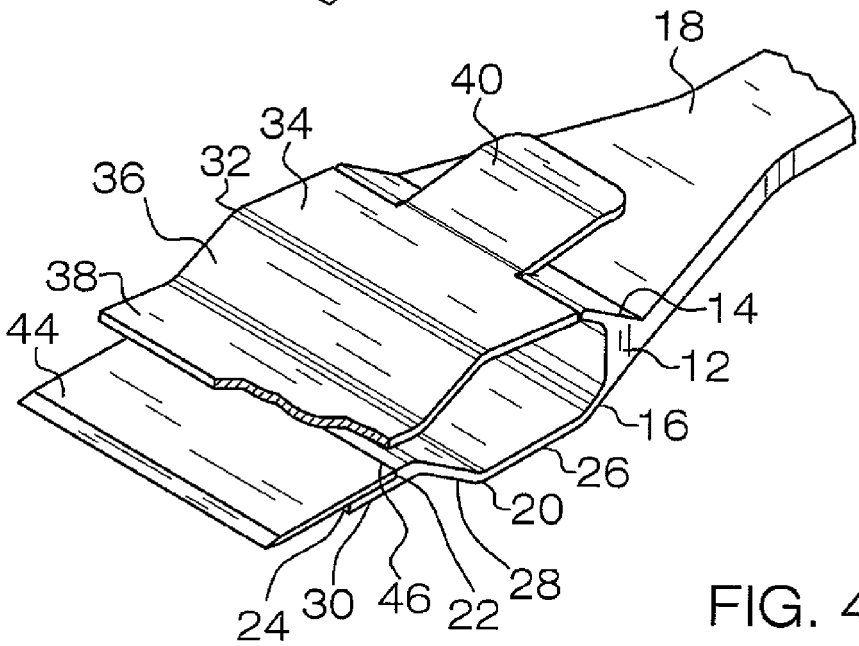
FIG. 4 is an enlarged perspective view of the present invention showing the blade positioned on the lower arm.
Figure 5:
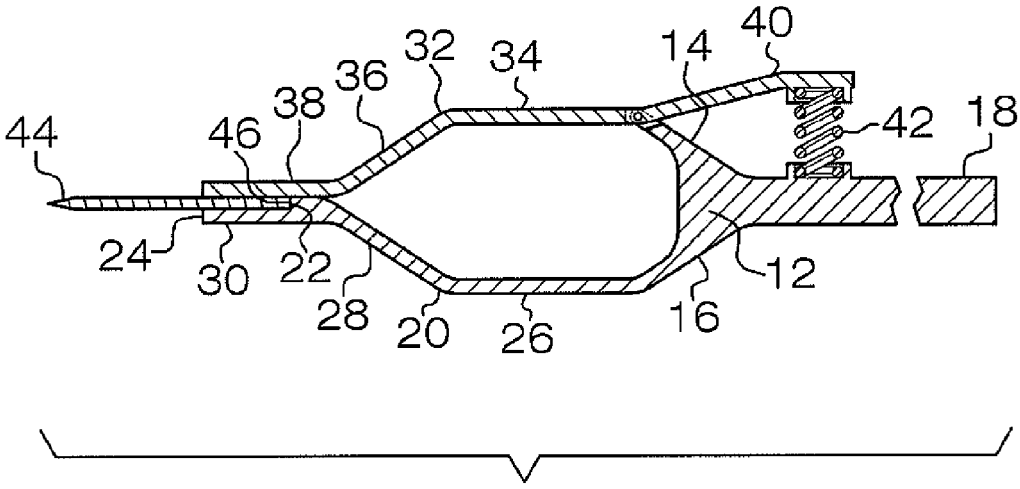
FIG. 5 is a cross-sectional view of the present invention taken along line 5-5 of FIG. 1.
Figure 6:
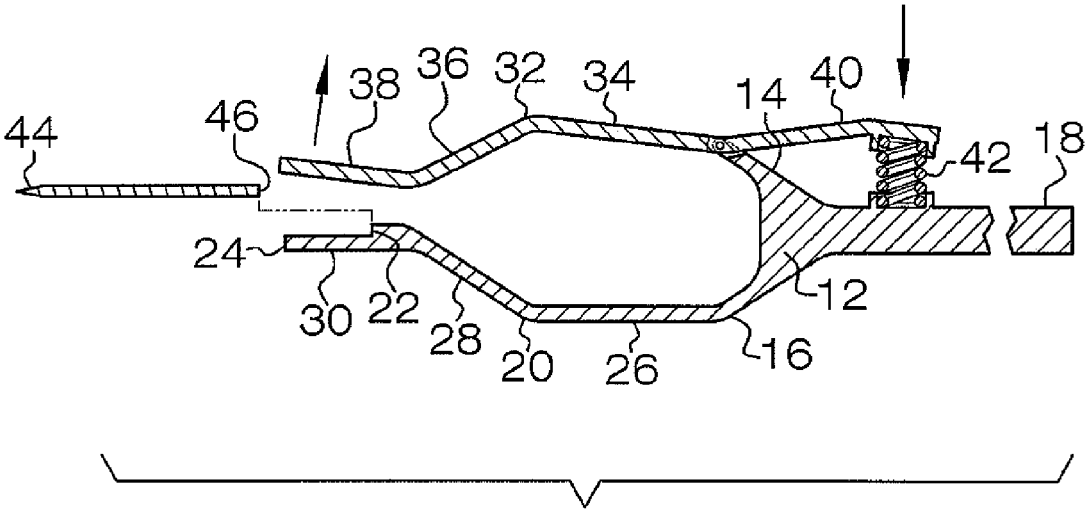
FIG. 6 is the cross-sectional view of the present invention shown in FIG. 5 with the upper arm pivoted away from the lower arm and the blade removed from the lower arm.

With reference now to the drawings, and in particular to FIGS. 1 through 8 thereof, a new scraping tool embodying the principles and concepts of the present invention and generally designated by the reference numeral 10 will be described.

As best illustrated in FIGS. 1 through 8, the scraping system 10 generally comprises a base member 12. An upper extension 14 is attached to the base member 12. The upper extension 14 extends upwardly at an angle with respect to the base member 12. A lower extension 16 is attached to the base member 12. The lower extension 16 extends downwardly at an angle with respect to the base member 12.

A handle 18 is coupled to and extending outwardly from the base member 12. The handle 18 is graspable to facilitate manipulation of the base member 12. The handle 18 extends generally in an opposite direction with respect to the lower 16 and upper 14 extensions.

A lower arm 20 is coupled to the lower extension 16. The lower arm 20 extends away from the handle 18 in a fixed orientation with respect to the handle 18. The lower arm 20 has a shoulder 22 being positioned adjacent a free end 24 of the lower arm 20. The lower arm 20 includes a bottom plate 26 coupled to the lower extension 16. The bottom plate 26 extends from the lower extension 16 in a plane approximately parallel to a plane including the handle 18.

The lower arm 20 also includes an angled plate 28 coupled to the bottom plate 26. The angled plate 28 extends upwardly at an angle with respect to the bottom plate 26. A terminal plate 30 is coupled to the angled plate 28. The terminal plate 30 is approximately parallel to and spaced from a plane of the bottom plate 26. The shoulder 22 is positioned in the terminal plate 30.

An upper arm 32 is pivotally coupled to the upper extension 14 of the base member 12. The upper arm 32 is pivotal towards the lower arm 20 to abut the lower arm 20. The upper arm 32 includes a top plate 34 being pivotally coupled the upper extension 14. The top plate 34 is orientated parallel to the bottom plate 26. A transition plate 36 is coupled to the top plate 34 distal the upper extension 14. The transition plate 36 extends downwardly at an angle with respect to the top plate 34.

The upper arm 32 also includes a distal plate 38 coupled to the transition plate 36. The distal plate 38 is orientated parallel to a plane of the top plate 34. The distal plate 38 abuts against the terminal plate 30 when the upper arm 32 is pivoted towards the lower arm 20. A tab 40 is coupled to the top plate 34 and extends back over the base member 12 and a portion of the handle 18. The tab 40 is pressed towards the handle 18 to pivot the upper arm 32 away from the lower arm 20.

A biasing member 42 biases the upper arm 32 against the lower arm 20. The biasing member 42 extends between the tab 40 and the base member 12. A blade 44 is positioned on the lower arm 20. The upper arm 32 is biased against the lower arm 20 and the blade 44 to press the blade 44 between the upper 32 and lower 20 arms and inhibit sliding of the blade 44 when the blade 44 is scraped across a surface. A rear edge 46 of the blade 44 abuts the shoulder 22 to inhibit sliding of the blade 44 towards the base member 12 and the handle 18 when the blade 44 is scraped along the surface. The system 10 has a length of approximately 12 inches and a width between approximately 3 inches to approximately 4 inches.

Figure 7:
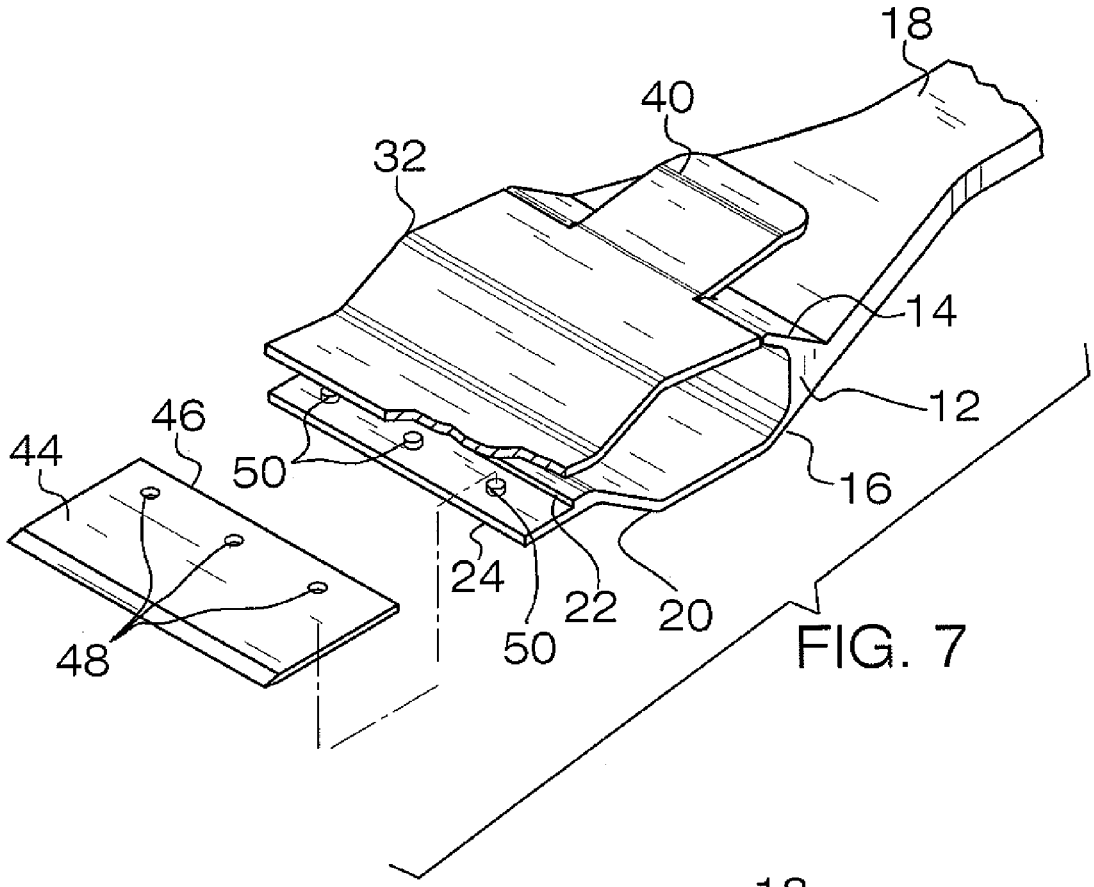
FIG. 7 is an enlarged perspective view of an embodiment of the present invention showing the blade removed from the lower arm.
Figure 8:
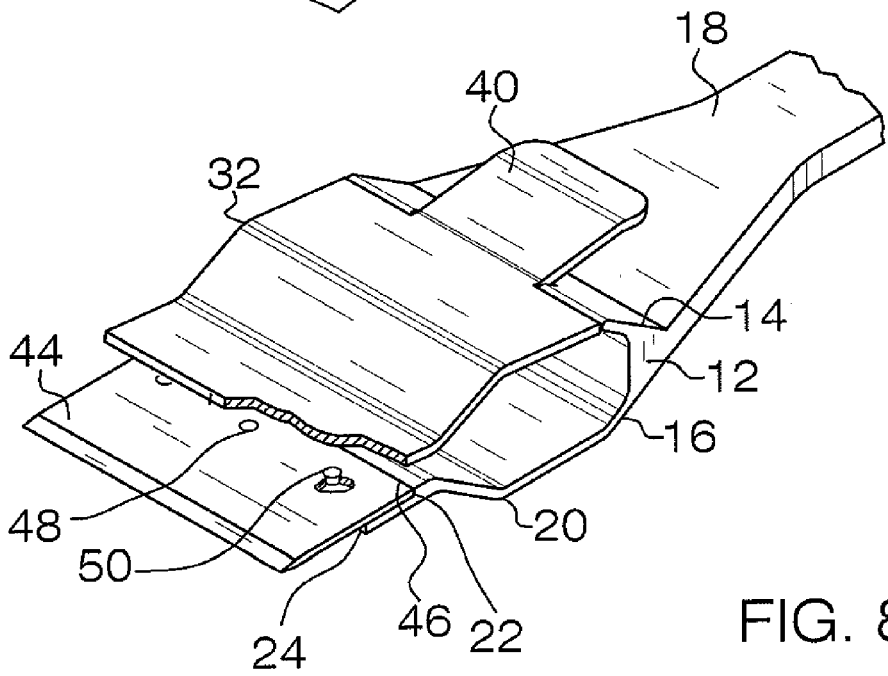
FIG. 8 is an enlarged perspective view of the embodiment of the present invention shown in FIG. 7 with the blade positioned on the lower arm.

In an embodiment, as shown in FIGS. 7 and 8, the blade 44 has a plurality of apertures 48 extending therethrough. Each of the apertures 48 are positioned adjacent the rear edge 46 of the blade 44. Each of the apertures 48 receives one of a plurality of indexing nubs 50 of the lower arm 20. The indexing nubs 50 are positioned adjacent the shoulder 22 to properly align the rear edge 46 of the blade 44 against the shoulder 22 of the lower arm 20 when said apertures 48 receive the indexing nubs 50.

In use, the tab 40 of the upper arm 32 is pressed toward the base member 12 to pivot the upper arm 32 away from the lower arm 20. The rear edge 46 of the blade 44 is positioned against the shoulder 22 of the lower arm 20. The tab 40 is released so that the biasing member 42 bases the upper arm 32 against the blade 44 and the lower arm 20 to secure the blade 44 between the upper arm 32 and the lower arm 20. The handle 18 is grasped to allow the blade 44 to be scraped along the surface. When the blade 44 requires changing the upper arm 32 is pivoted away from the lower arm 20, which facilitates cleaning between the upper arm 32 and the lower arm 20, especially when scraping hardwood floors.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A scraping system for scraping a surface, said system comprising:

a base member;

an upper extension being attached to said base member, said upper extension extending upwardly at an angle with respect to said base member;

a lower extension being attached to said base member, said lower extension extending downwardly at an angle with respect to said base member;

a lower arm being coupled to said lower extension;

an upper arm being pivotally coupled to said upper extension of said base member, said upper arm being pivotal towards said lower arm to abut said lower arm;

a blade being positioned on said lower arm, said upper arm being biased against said lower arm and said blade to press said blade between said upper and lower arms and inhibit sliding of said blade when said blade is scraped across the surface;

said upper arm including a top plate being pivotally coupled to said upper extension, said top plate extending from said upper extension in a plane approximately parallel to a plane of said lower arm; and said upper arm including a tab being coupled to said top plate and extending back over said base member and a portion of said handle, said tab being pressed towards said handle to pivot said upper arm away from said lower arm;

a biasing member biasing said upper arm against said lower arm, said biasing member extending between said tab and said base member.

2. The system according to claim 1, further comprising a handle being coupled to and extending outwardly from said base member, said handle being graspable to facilitate manipulation of said base member, said handle extending generally in an opposite direction with respect to said lower and upper extensions, said lower arm extending away from said handle.

3. The system according to claim 1, wherein said lower arm has a shoulder being positioned adjacent a free end of said lower arm, a rear edge of said blade abutting said shoulder to inhibit sliding of said blade towards said base member and said handle when said blade is scraped along the surface.

4. The system according to claim 3, wherein said blade has a plurality of apertures extending therethrough, each of said apertures being positioned adjacent said rear edge of said blade, each of the apertures receiving one of a plurality of indexing nubs of said lower arm, said indexing nubs being positioned adjacent said shoulder to properly align said rear edge of said blade against said shoulder of said lower arm when said apertures receive said indexing nubs.

5. The system according to claim 1, wherein said lower arm includes a bottom plate being coupled to said lower extension, said bottom plate extending from said lower extension in a plane approximately parallel to a plane of said upper arm.

6. The system according to claim 5, wherein said lower arm includes an angled plate being coupled to said bottom plate, said angled plate extending upwardly at an angle with respect to said bottom plate.

7. The system according to claim 6, wherein said lower arm includes a terminal plate being coupled to said angled plate, said terminal plate being approximately parallel to and spaced from a plane of said bottom plate.

8. The system according to claim 1, wherein said upper arm includes a transition plate being coupled to said top plate distal said upper extension, said transition plate extending downwardly at an angle with respect to said top plate.

9. The system according to claim 8, wherein said upper arm includes a distal plate being coupled to said transition plate, said distal plate being orientated parallel to a plane of said top plate, said distal plate abutting against said lower arm when said upper arm is pivoted towards said lower arm.

10. A scraping system for scraping a surface, said system comprising:

a base member;

an upper extension being attached to said base member, said upper extension extending upwardly at an angle with respect to said base member;

a lower extension being attached to said base member, said lower extension extending downwardly at an angle with respect to said base member;

a handle being coupled to and extending outwardly from said base member, said handle being graspable to facilitate manipulation of said base member, said handle extending generally in an opposite direction with respect to said lower and upper extensions;

a lower arm being coupled to said lower extension, said lower arm extending away from said handle, said lower arm having a shoulder being positioned adjacent a free end of said lower arm, said lower arm comprising;

a bottom plate being coupled to said lower extension, said bottom plate extending from said lower extension in a plane approximately parallel to a plane of said handle;

an angled plate being coupled to said bottom plate, said angled plate extending upwardly at an angle with respect to said bottom plate;

a terminal plate being coupled to said angled plate, said terminal plate being approximately parallel to and spaced from a plane of said bottom plate, said shoulder being positioned in said terminal plate;

an upper arm being pivotally coupled to said upper extension of said base member, said upper arm being pivotal towards said lower arm to abut said lower arm; said upper arm comprising;

a top plate being pivotally coupled said upper extension, said top plate being orientated parallel to said bottom plate;

a transition plate being coupled to said top plate distal said upper extension, said transition plate extending downwardly at an angle with respect to said top plate;

a distal plate being coupled to said transition plate, said distal plate being orientated parallel to a plane of said top plate, said distal plate abutting against said terminal plate when said upper arm is pivoted towards said lower arm;

a tab being coupled to said top plate and extending back over said base member and a portion of said handle, said tab being pressed towards said handle to pivot said upper arm away from said lower arm;

a biasing member biasing said upper arm against said lower arm, said biasing member extending between said tab and said base member; and a blade being positioned on said lower arm, said upper arm being biased against said lower arm and said blade to press said blade between said upper and lower arms and inhibit sliding of said blade when said blade is scraped across the surface, a rear edge of said blade abutting said shoulder to inhibit sliding of said blade towards said base member and said handle when said blade is scraped along the surface.

* * * * *